US011654487B2

(12) United States Patent
Nakaseko et al.

(10) Patent No.: US 11,654,487 B2
(45) **Date of Patent: *May 23, 2023**

(54) PRODUCTION METHOD FOR WATER-ATOMIZED METAL POWDER

(71) Applicant: JFE Steel Corporation, Tokyo (JP)

(72) Inventors: Makoto Nakaseko, Tokyo (JP); Naomichi Nakamura, Tokyo (JP); Akio Kobayashi, Tokyo (JP); Takuya Takashita, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/282,444

(22) PCT Filed: Oct. 10, 2019

(86) PCT No.: PCT/JP2019/040049

§ 371 (c)(1),
(2) Date: Apr. 2, 2021

(87) PCT Pub. No.: WO2020/075814

PCT Pub. Date: Apr. 16, 2020

(65) Prior Publication Data

US 2021/0379657 A1 Dec. 9, 2021

(30) Foreign Application Priority Data

Oct. 11, 2018 (JP) ..... JP2018-192257

(51) Int. Cl.
*B22F 9/08* (2006.01)
*C22C 33/02* (2006.01)
(Continued)

(52) U.S. Cl.
CPC ..... *B22F 9/082* (2013.01); *B22F 1/05* (2022.01); *C22C 33/0278* (2013.01);
(Continued)

(58) Field of Classification Search
None
See application file for complete search history.

(56) References Cited

U.S. PATENT DOCUMENTS 3,814,558 A * 6/1974 Ayers ..... B22F 9/082 425/10
8,277,579 B2 10/2012 Makino
(Continued)

FOREIGN PATENT DOCUMENTS

CN 101062522 A 10/2007
CN 106132599 A 11/2016
(Continued)

OTHER PUBLICATIONS

Extended European Seach Report for European Application No. 19871768.8, dated Sep. 10, 2021, 10 pages.
(Continued)

*Primary Examiner* — George Wyszomierski
(74) *Attorney, Agent, or Firm* — RatnerPrestia

(57) ABSTRACT

A production method for water-atomized metal powder includes: in a region in which the average temperature of a molten metal stream having an Fe concentration of 76.0 at % or more and less than 82.9 at % is 100° C. or more higher than the melting point, spraying primary cooling water at a convergence angle of 10° to 25°, where the convergence angle is an angle between an impact direction on the molten metal stream from one direction and an impact direction on the molten metal stream from any other direction; and in a region in which 0.0004 seconds or more have passed after an impact of the primary cooling water and the average tem-
(Continued)

perature of metal powder is the melting point or higher and (the melting point+100° C.) or lower, spraying secondary cooling water on the metal powder under conditions of an impact pressure of 10 MPa or more.

4 Claims, 4 Drawing Sheets

(51) Int. Cl.
*C22C 45/02* (2006.01)
*H01F 1/153* (2006.01)
*B22F 1/05* (2022.01)

(52) U.S. Cl.
CPC ..... *C22C 45/02* (2013.01); *H01F 1/153* (2013.01); *B22F 2009/0828* (2013.01); *B22F 2301/35* (2013.01); *B22F 2304/10* (2013.01); *C22C 2200/02* (2013.01); *C22C 2202/02* (2013.01)

(56) References Cited

U.S. PATENT DOCUMENTS

| | | | | |
|---|---|---|---|---|
| 8,282,745 | B2 | 10/2012 | Tsuchiya et al. | |
| 9,850,562 | B2 | 12/2017 | Urata et al. | |
| 2007/0246131 | A1 | 10/2007 | Watanabe | |
| 2017/0144227 | A1 | 5/2017 | Nakaseko et al. | |
| 2018/0001386 | A1* | 1/2018 | Lyu | B22F 9/082 |
| 2018/0071826 | A1* | 3/2018 | Nakaseko | B22F 9/082 |
| 2021/0379658 | A1* | 12/2021 | Nakaseko | B22F 1/05 |

FOREIGN PATENT DOCUMENTS

| | | | |
|---|---|---|---|
| CN | 107427926 | A | 12/2017 |
| EP | 3838451 | A1 | 6/2021 |
| JP | 07102307 | A | 4/1995 |
| JP | 2710938 | B2 | 2/1998 |
| JP | 2001064704 | A | 3/2001 |
| JP | 2008231533 | A | 10/2008 |
| JP | 2008231534 | A | 10/2008 |
| JP | 2008240041 | A | 10/2008 |
| JP | 4288687 | B2 | 7/2009 |
| JP | 4310480 | B2 | 8/2009 |
| JP | 4815014 | B2 | 11/2011 |
| JP | 2016014162 | A | 1/2016 |
| JP | 2017031462 | A | 2/2017 |
| JP | 2017031464 | A | 2/2017 |
| JP | 2017031465 | A | 2/2017 |
| JP | 2018115363 | A | 7/2018 |
| JP | 6372442 | B2 | 8/2018 |
| JP | 2020105593 | A | 7/2020 |
| KR | 20140075105 | A | 6/2014 |
| WO | 2010084900 | A1 | 7/2010 |

OTHER PUBLICATIONS

Makino A., et al.,"The Trend and the Prospects of Nanocrystalline Soft Magnetic Materials", Materia Japan, vol. 41, No. 6, 2002, 16 pages, (2002).
Fukuoka, T., et al., "Evaluation of Thermal Contact Resistance at the Interface Composed of Dissimilar Materials," Transactions of the JSME A, 76 (763), 17 pages, (Mar. 25, 2010).
Toraya, "WPPD Method", Journal of the Crystallographic Society of Japan, vol. 30(4), 13 pages, (1988).
Makino A., et al., "Soft Magnetic FeSiBPCu Heteroamorphous Alloys with High Fe Content," Journal of Applied Physics 105, 013922-1-013922-4, (2009).
International Search Report and Written Opinion for International Application No. PCT/JP2019/040049, dated Dec. 3, 2019, 5 pages.
Makino et al., "The Trend and the Prospects of Nanocrystalline Soft Magnetic Materials", Materia Japan. vol. 41, No. 6, 2002, pp. 392-396.
Canadian Office Action for Canadian Application No. 3,110,028, dated Jan. 10, 2022, 4 pages.
Korean Notice of Allowance for Korean Application No. 10-2021-7010152, dated May 12, 2022, with translation, 4 pages.
Chinese Office Action with Search Report for Chinese Application No. 201980066340.5, dated Sep. 30, 2022, 9 pages.
Canadian Office Action for Canadian Application No. 3,110,028, dated Mar. 9, 2023, 4 pages.

* cited by examiner

PRODUCTION METHOD FOR WATER-ATOMIZED METAL POWDER

CROSS REFERENCE TO RELATED APPLICATIONS

This is the U.S. National Phase application of PCT/JP2019/040049, filed Oct. 10, 2019, which claims priority to Japanese Patent Application No. 2018-192257, filed Oct. 11, 2018, the disclosures of these applications being incorporated herein by reference in their entireties for all purposes.

FIELD OF THE INVENTION

The present invention relates to a production method for water-atomized metal powder. The present invention is particularly suitable for the production of water-atomized metal powder whose total content of iron-group components (Fe, Ni, Co) in atomic percent is 76.0 at % or more and less than 82.9 at %.

BACKGROUND OF THE INVENTION

Against a backdrop of increasing production of hybrid vehicles (HVs), electric vehicles (EVs), and fuel cell vehicles (FCVs), there is a need for further low iron loss, high efficiency, and downsizing of reactors and motor cores used for such vehicles.

Such reactors and motor cores have been produced by stacking thinned electrical steel sheets. Meanwhile, motor cores made by compacting metal powder, which has a high degree of freedom in shape design, are attracting attention these days.

To lower iron loss of reactors and motor cores, amorphization of metal powder to be used is considered to be effective.

Moreover, it is required to increase the magnetic flux density of metal powder for further high output and downsizing. For this purpose, it is important to increase the concentration of Fe-group elements including Ni and Co. Accordingly, there is a growing need for amorphous soft magnetic metal powder having a concentration of Fe-group elements of 76% or more.

Iron powder as metal powder is amorphized by quenching from the molten state after atomization. As the concentration of Fe-group elements increases for the purpose of increasing the magnetic flux density, further rapid quenching is required.

A cause to impede the increase in cooling rate of metal powder, in particular, in the high-temperature molten state is as follows. When water comes into contact with molten steel, water instantaneously evaporates and forms a vapor film around the molten steel to reach the film boiling state, which impedes direct contact between water and the surface to be cooled, thereby making it difficult to increase the cooling rate.

Moreover, when atomized metal powder is used by compacting into reactors and motor cores, low core loss is important for low loss and high efficiency. For this purpose, it is important that atomized metal powder is amorphous. At the same time, the shape of atomized metal powder frequently has decisive influence thereon. In other words, as the shape of atomized metal powder becomes further spherical, core loss tends to decrease. Furthermore, a spherical shape and an apparent density are closely related. As an apparent density increases, powder takes further spherical shapes. In recent years, an apparent density of 3.0 g/cm$^3$ or more is particularly needed as a desired property of atomized metal powder.

As in the foregoing, the following three points are needed as the properties of water-atomized metal powder used for reactors and motor cores.

1) a possible high concentration of Fe-group elements for further high performance and downsizing of motors 2) metal powder being amorphous and having a high apparent density for low loss and high efficiency Moreover, the following is also needed due to growing demand for water-atomized metal powder against a backdrop of increasing HVs, EVs, and FCVs.

3) high productivity due to low costs

PATENT LITERATURE

PTL 1: Japanese Unexamined Patent Application Publication No. 2001-64704

SUMMARY OF THE INVENTION

As a measure to perform amorphization and shape control of metal powder by an atomization process, the method described in Patent Literature 1 has been proposed.

In Patent Literature 1, metal powder is obtained by dividing a molten metal stream by gas jets at a jet pressure of 15 to 70 kg/cm$^2$ to disperse the molten metal stream while allowing to fall the distance of 10 mm or more and 200 mm or less, thereby causing to enter a water stream at an incident angle of 30° or more and 90° or less. According to Patent Literature 1, amorphous powder cannot be obtained at an incident angle of less than 30° and the shape deteriorates at a jet angle of more than 90°.

Meanwhile, for a method of dividing a molten metal stream by an atomization process, there are a water atomization process and a gas atomization process. A water atomization process is a process of obtaining metal powder by spraying cooling water on a molten metal stream to divide molten steel, whereas a gas atomization process is a process of ejecting an inert gas on a molten metal stream. Patent Literature 1 describes a gas atomization process in which a molten metal stream is first divided by a gas.

In a water atomization process, atomized metal powder is obtained by dividing a molten steel stream by water jets emitted from nozzles or the like to form powdery metal (metal powder) and simultaneously cool the metal powder with the water jets. Meanwhile, a gas atomization process uses an inert gas ejected from nozzles. In the case of gas atomization, separate equipment for cooling after atomization is installed in some cases due to the low capability of cooling molten steel.

For producing metal powder, a water atomization process, which uses water alone, exhibits higher production capacity and lower costs than a gas atomization process. However, metal powder particles produced by a water atomization process have various shapes. In particular, when division and cooling are simultaneously performed to obtain amorphous metal powder, the apparent density becomes less than 3.0 g/cm$^3$ since molten steel solidifies as is divided.

Meanwhile, a gas atomization process needs to use a large amount of inert gas and is inferior, to a water atomization process, in ability to divide molten steel during atomization. However, metal powder produced by a gas atomization process tends to have particle shapes closer to a sphere and a higher apparent density than those by water atomization since the time from division to cooling is longer than that in water atomization and thus molten steel becomes spherical due to surface tension until solidification, followed by cooling. Patent Literature 1 achieves both sphere formation and amorphization of metal powder by adjusting the jet angle of water during cooling after gas atomization. However, gas atomization has problems of low productivity and high production costs due to the use of a large amount of inert gas as in the foregoing.

Aspects of the present invention have been made to resolve the above-mentioned problems, and an object according to aspects of the present invention is to provide a production method for water-atomized metal powder whose amorphous proportion and apparent density can be increased by a low-cost high-productivity water atomization process even if the metal powder has a high Fe concentration.

The present inventors continued intensive studies to resolve the above-mentioned problems. As a result, it was found possible to resolve the above-mentioned problems by a production method for water-atomized metal powder, including: spraying primary cooling water that is to impact on a vertically falling molten metal stream to divide the molten metal stream into metal powder and to cool the metal powder, thereby producing water-atomized metal powder, where: in a region in which an average temperature of the molten metal stream is 100° C. or more higher than a melting point, the primary cooling water is sprayed from a plurality of directions to cause the primary cooling water to impact on a guide having a slanting surface that slants toward the molten metal stream and to move the primary cooling water along the slanting surface, thereby adjusting a convergence angle to 10° to 25°, the convergence angle being an angle between an impact direction on the molten metal stream of the primary cooling water from one direction among a plurality of the directions and an impact direction on the molten metal stream of the primary cooling water from any other direction; and in a region in which 0.0004 seconds or more have passed after an impact of the primary cooling water and an average temperature of the metal powder is a melting point or higher and (the melting point+100° C.) or lower, secondary cooling water is sprayed on the metal powder under conditions of an impact pressure of 10 MPa or more. Aspects of the present invention specifically provide the following.

[1] A production method for water-atomized metal powder, including: spraying primary cooling water that is to impact on a vertically falling molten metal stream to divide the molten metal stream into metal powder and to cool the metal powder, thereby producing water-atomized metal powder having a total content of iron-group components (Fe, Ni, Co) in atomic percent of 76.0 at % or more and less than 82.9 at % and an amorphous proportion of 95% or more, where: in a region in which an average temperature of the molten metal stream is 100° C. or more higher than a melting point, the primary cooling water is sprayed from a plurality of directions to cause the primary cooling water to impact on a guide having a slanting surface that slants toward the molten metal stream and to move the primary cooling water along the slanting surface, thereby adjusting a convergence angle to 10° to 25°, the convergence angle being an angle between an impact direction on the molten metal stream of the primary cooling water from one direction among a plurality of the directions and an impact direction on the molten metal stream of the primary cooling water from any other direction; and in a region in which 0.0004 seconds or more have passed after an impact of the primary cooling water and an average temperature of the metal powder is a melting point or higher and (the melting point+100° C.) or lower, secondary cooling water is sprayed on the metal powder under conditions of an impact pressure of 10 MPa or more.

[2] The production method for water-atomized metal powder according to [1], where the water-atomized metal powder has Cu content in atomic percent of 0.1 at % or more and 2 at % or less.

[3] The production method for water-atomized metal powder according to [1] or [2], where the water-atomized metal powder has an average particle size of 5 μm or more.

According to aspects of the present invention, it has become possible at an apparent density of 3.0 g/cm$^3$ or more to attain an amorphous proportion of 95% or more of water-atomized metal powder. Moreover, water-atomized metal powder obtained in accordance with aspects of the present invention allows deposition of nanosized crystals through appropriate heat treatment after compacting.

In particular, it becomes possible for water-atomized metal powder having a high content of iron-group elements to achieve both low loss and high magnetic flux density through appropriate heat treatment after compacting of the metal powder.

In addition, nanocrystal materials and heteroamorphous materials exhibiting a high magnetic flux density have been developed in recent years as described in Materia Japan vol. 41, No. 6, p. 392; Journal of Applied Physics 105, 013922 (2009); Japanese Patent No. 4288687; Japanese Patent No. 4310480; Japanese Patent No. 4815014; International Publication No. 2010/084900; Japanese Unexamined Patent Application Publication No. 2008-231534; Japanese Unexamined Patent Application Publication No. 2008-231533; and Japanese Patent No. 2710938, for example. Aspects of the present invention are highly advantageously suitable for the production of such metal powder having a high content of iron-group elements by a water atomization process. In particular, when the concentration of Fe-group components in at % is 76% or more, it was difficult to increase an amorphous proportion by conventional techniques. However, it is possible by applying the production method according to aspects of the present invention to attain an amorphous proportion after water atomization of 95% or more as well as an apparent density of 3.0 g/cm$^3$ or more.

Further, it was extremely difficult to attain an amorphous proportion of 95% or more and an average particle size of 5 μm or more by conventional techniques. When a particle size is large, the inner portion of the particle to be cooled later than the surface undergoes gradual cooling. As a result, stable attainment of a high amorphous proportion tends to fail. However, it is possible by applying the production method according to aspects of the present invention to attain an amorphous proportion of 95% or more even if an average particle size is increased. Further, when an amorphous proportion of 95% or more and an average particle size of 5 μm or more are possible, a magnetic flux density (specifically, a saturated magnetic flux density value) is increased tremendously through appropriate heat treatment after compacting.

DETAILED DESCRIPTION OF EMBODIMENTS OF THE INVENTION

Hereinafter, embodiments of the present invention will be described. However, the present invention is not limited to the following embodiments.

Figure 1:
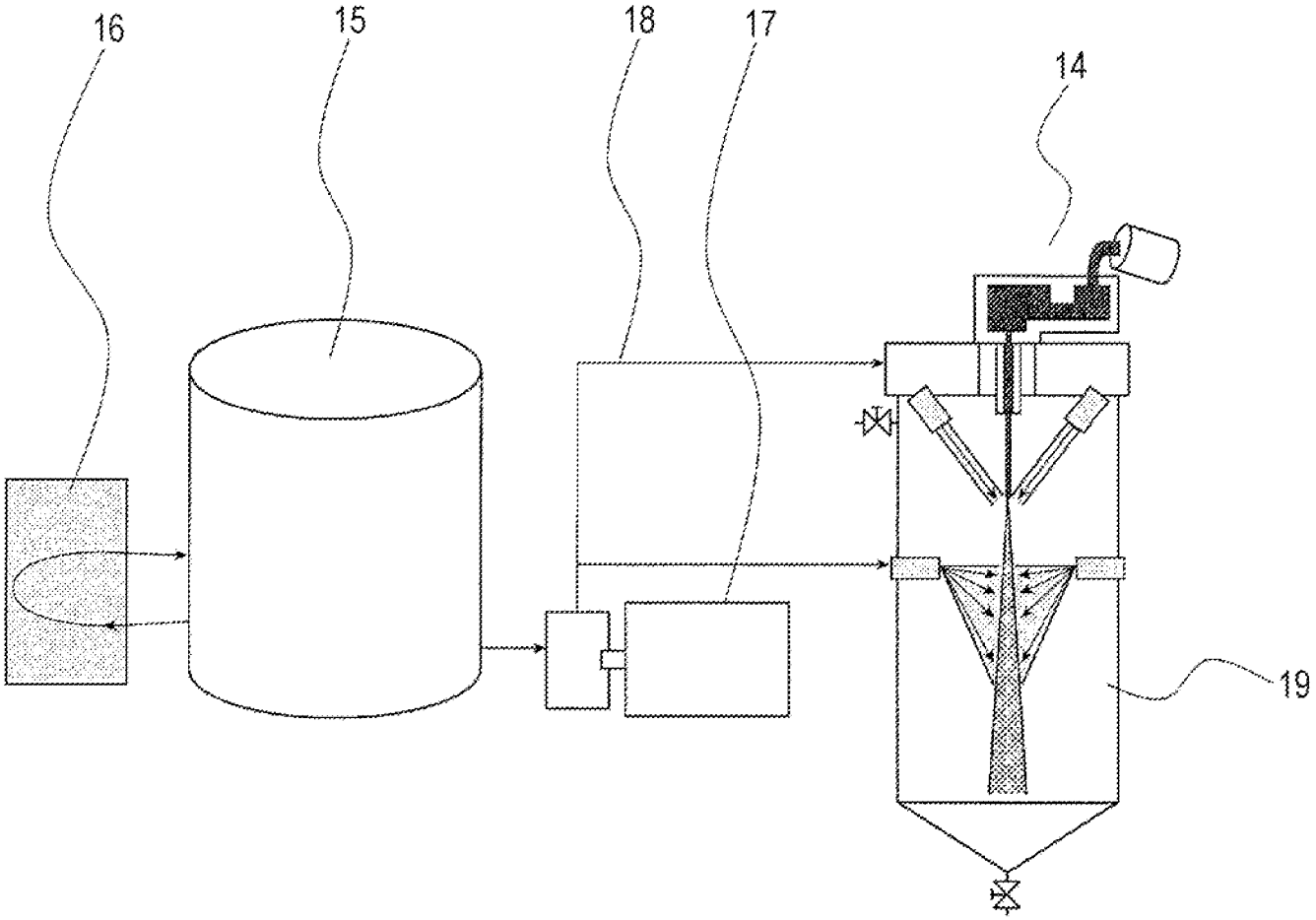
FIG. 1 schematically illustrates a production apparatus for water-atomized metal powder used for the production method of a present embodiment.
Figure 2:
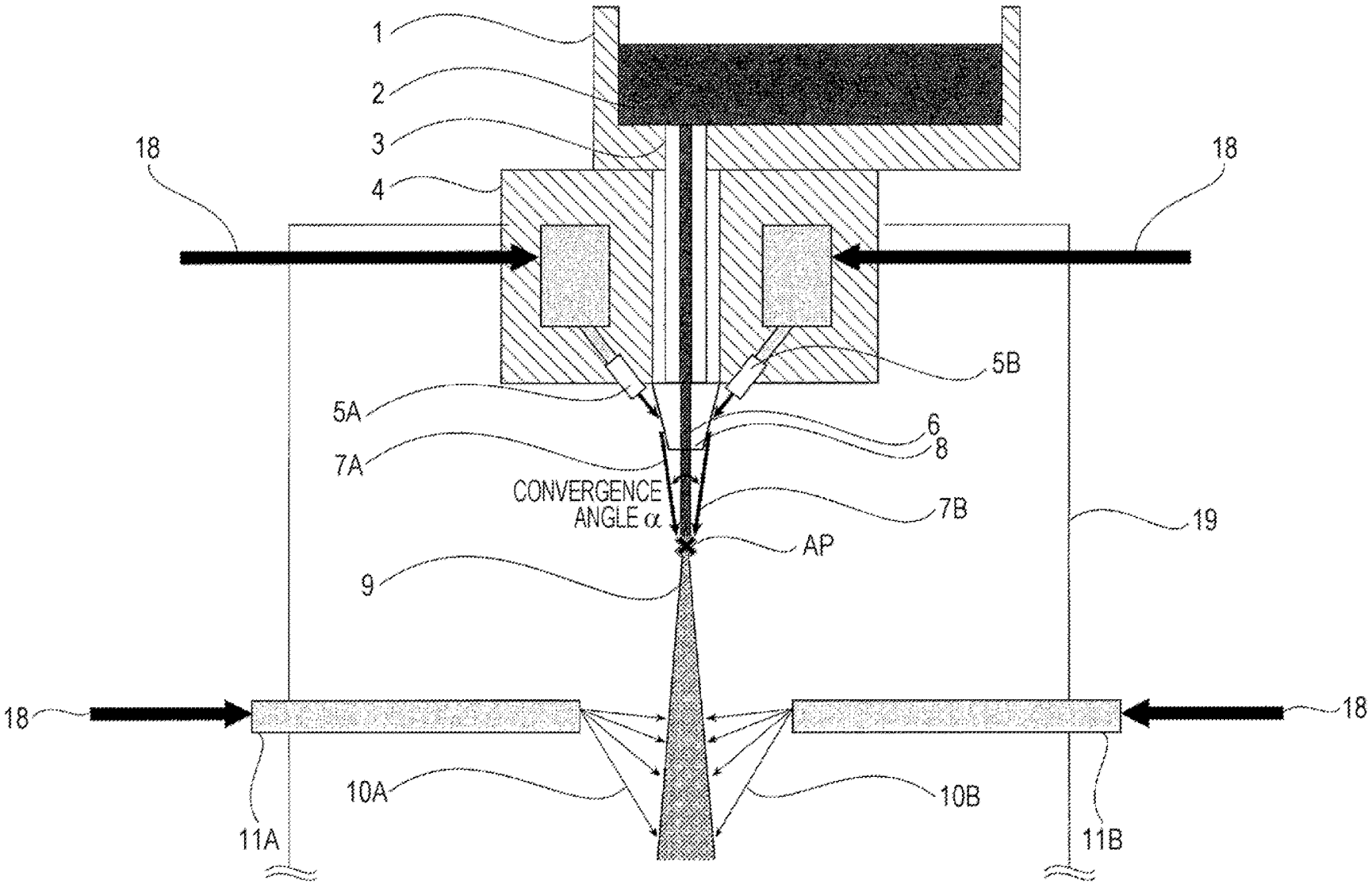
FIG. 2 schematically illustrates an atomizing apparatus used for the production method of the present embodiment.

FIG. 1 schematically illustrates a production apparatus for water-atomized metal powder used for the production method of a present embodiment. FIG. 2 schematically illustrates an atomizing apparatus used for the production method of the present embodiment.

In the production apparatus for water-atomized metal powder of FIG. 1, the temperature of cooling water in a cooling water tank 15 is adjusted using a temperature controller for cooling water 16. Temperature-adjusted cooling water is transferred to a high-pressure pump for atomizing/cooling water 17. Cooling water is then transferred from the high-pressure pump for atomizing/cooling water 17 to an atomizing apparatus 14 through a pipe for atomizing/cooling water 18. Metal powder is produced in a chamber 19 of the atomizing apparatus 14 by spraying cooling water on a vertically falling molten metal stream, thereby dividing the molten metal stream into metal powder and cooling the metal powder. In the present embodiment, molten steel is cooled by primary cooling water and secondary cooling water. For this purpose, primary cooling water and secondary cooling water are supplied to the atomizing apparatus 14 from the high-pressure pump for atomizing/cooling water 17 through the branched pipe for atomizing/cooling water 18. The present embodiment is provided with one high-pressure pump for atomizing/cooling water, but two or more high-pressure pumps for atomizing/cooling water may be provided for each cooling water.

The production method according to aspects of the present invention is featured by production conditions in the atomizing apparatus 14. By means of FIG. 2, the production conditions in the production method for water-atomized metal powder according to aspects of the present invention will be described.

The atomizing apparatus 14 of FIG. 2 includes a tundish 1, a molten steel nozzle 3, a primary cooling nozzle header 4, primary cooling spray nozzles 5 (denoted by 5A and 5B), a guide 8, secondary cooling spray nozzles 11 (denoted by 11A and 11B), and a chamber 19.

The tundish 1 is a container-like member into which molten steel 2 melted in a melting furnace is poured. A common tundish may be used as the tundish 1. As illustrated in FIG. 1, an opening is formed on the bottom of the tundish 1 for connecting the molten steel nozzle 3.

It is possible to adjust the composition of water-atomized metal powder to be produced by adjusting the composition of the molten steel 2. The production method according to aspects of the present invention is suitable for the production of atomized metal powder having a total content of iron-group components (Fe, Ni, Co) in atomic percent of 76.0 at % or more and less than 82.9 at % as well as having Cu content in atomic percent of 0.1 at % or more and 2 at % or less and/or an average particle size of 5 μm or more. Accordingly, to produce water-atomized metal powder having the above-mentioned composition, the composition of the molten steel 2 may be adjusted within the above-mentioned range.

The molten steel nozzle 3 is a tubular body connected to the opening on the bottom of the tundish 1. The molten steel 2 passes through the inside of the molten steel nozzle 3. When the length of the molten steel nozzle 3 is long, the temperature of the molten steel 2 decreases while passing therethrough. In accordance with aspects of the present invention, it is required to spray primary cooling water described hereinafter in a region where the temperature of the molten steel 2 is higher than the melting point of the molten steel 2 by 100° C. or more. For this reason, the length of the molten steel nozzle 3 is preferably 50 to 350 mm. The temperature of the molten steel 2 is determined by the method described hereinafter.

The primary cooling nozzle header 4 has a space therein for holding cooling water transferred through the pipe for atomizing/cooling water 18. In the present embodiment, the primary cooling nozzle header 4 is a ring body provided to surround the side surface of the tubular molten steel nozzle 3 and is configured to hold cooling water inside thereof.

The primary cooling spray nozzles 5 comprise a primary cooling spray nozzle 5A and a primary cooling spray nozzle 5B. The primary cooling spray nozzles 5A and 5B are provided at the bottom surface of the primary cooling nozzle header 4 and spray water hold inside the primary cooling nozzle header 4 as primary cooling water 7 (corresponding to primary cooling water, denoted by 7A and 7B). During such spraying, the spray directions can be set appropriately by adjusting the directions of the primary cooling spray nozzles 5A and 5B. In the present embodiment, a convergence angle α, which is an angle between an impact direction on the molten metal stream 6 of the primary cooling water 7A from the primary cooling spray nozzle 5A and an impact direction on the molten metal stream 6 of the primary cooling water 7B from the primary cooling spray nozzle 5B, is adjusted to 10° to 25° by a guide 8 described hereinafter.

The number of the primary cooling spray nozzles 5 may be any number more than one and is not particularly limited. From a viewpoint of obtaining the effects according to aspects of the present invention, the number of the primary cooling spray nozzles 5 is preferably 4 or more and 20 or less.

When the number of the primary cooling spray nozzles 5 is three or more, the convergence angle α formed by any two nozzles may fall within the range of 10° to 25°. However, to obtain the effects according to aspects of the present invention, the convergence angles α formed by any of the nozzles preferably fall within the range of 10° to 25°.

Moreover, the primary cooling spray nozzle 5A and the primary cooling spray nozzle 5B are provided at almost facing positions across the molten metal stream 6 in the present embodiment. At least two primary cooling spray nozzles, whose convergence angle α falls within the range of 10° to 25°, are preferably provided at almost facing positions across the molten metal stream 6 as in the present embodiment in view of easy formation of metal powder. Herein, "almost facing" means facing within the range of 180°±10° with the molten metal stream as the center in the planar view. Further, when three or more primary cooling spray nozzles are provided, such primary cooling spray nozzles are preferably disposed at roughly equal intervals (equal interval±10°). Still further, the number of the primary cooling spray nozzles is preferably four or more.

The amount of cooling water sprayed from the primary cooling spray nozzles 5 may be any amount provided that the molten metal stream 6 can be divided into the metal powder 9. For example, the molten metal stream 6 typically has a diameter on the cross-section perpendicular to the falling direction of about 1.5 to 10 mm. The amount of cooling water sprayed from the primary cooling spray nozzles 5 is determined by the amount of molten steel, and a ratio of water to molten steel (water/molten steel ratio) is preferably about 5 to 40 [–] and possibly within the range of 10 to 30 [–] (when the amount of falling molten steel of 10 kg/min and a primary cooling water/molten steel ratio of 30 [–] are desirable, the amount of primary cooling water is 300 kg/min). Moreover, the amount of water sprayed from each primary cooling spray nozzle 5 may be different from each other or may be the same. However, from a viewpoint of forming uniform metal powder 9, the amount of water is preferably of small difference from each other. Specifically, the difference between the maximum and the minimum amounts of water sprayed from each nozzle is preferably ±20% or less.

In the present embodiment, the impact directions of primary cooling water are adjusted by the guide 8 described hereinafter. For this reason, the impact pressure of the primary cooling water 7 on the molten metal stream 6 is almost constant among primary cooling spray nozzles 5. However, when the primary cooling water 7 is allowed to impact on the molten metal stream 6 directly from each primary cooling spray nozzle 5, it is preferable to adjust the impact pressure such that the metal powder 9 is easily formed.

The types of the primary cooling spray nozzles 5 are not particularly limited. Here, a convergence angle is determined by causing cooling water to impact on an angle modification section of a guide that regulates the convergence angle, thereby changing the angle of the cooling water. For this reason, solid-type (a type for spraying in a straight line) spray nozzles are preferable since cooling water sprayed from the primary cooling spray nozzles 5 are better not to spread such that all the cooling water impacts on the angle modification section of the guide.

The guide 8 (corresponding to the guide) is a member for adjusting impact directions on the molten metal stream 6 of the primary cooling water 7A and the primary cooling water 7B sprayed from the primary cooling spray nozzle 5A and the primary cooling spray nozzle 5B, respectively. In the present embodiment, the guide 8 is a ring body that has a tapered side surface and inner space through which the molten steel 2 passes. The top surface in the vertical direction of the guide 8 along the extending direction of the space through which the molten steel 2 passes is connected to the end face in the falling direction of the molten steel nozzle 3 such that the molten steel 2 flows into the guide 8 from the molten steel nozzle 3.

In the present embodiment, the impact directions on the molten metal stream 6 of the primary cooling water 7A and the primary cooling water 7B are adjusted by allowing the primary cooling water 7A and the primary cooling water 7B to flow along the tapered side surface of the guide 8.

The length in the vertical direction (falling direction) of the guide 8 is not particularly limited but is preferably 30 to 80 mm from a viewpoint of, as in the foregoing, adjusting the directions of the primary cooling water 7A and the primary cooling water 7B as well as needing to cause the primary cooling water 7A and the primary cooling water 7B to impact on the molten metal stream 6 at a high temperature.

The chamber 19 forms, below the primary cooling nozzle header 4, the space for producing metal powder. In the present embodiment, openings are formed on the side surfaces of the chamber 19 such that cooling water from the pipe for atomizing/cooling water 18 is allowed to flow into the secondary cooling spray nozzles 11 described hereinafter.

The secondary cooling spray nozzles 11 comprise a secondary cooling spray nozzle 11A and a secondary cooling spray nozzle 11B. The secondary cooling spray nozzle 11A and the secondary cooling spray nozzle 11B are each fixed to the side surfaces of the chamber 19 and spray cooling water supplied from the pipe for atomizing/cooling water 18 as secondary cooling water 10 (denoted by 10A and 10B). The secondary cooling water 10 sprayed from the secondary cooling spray nozzle 11A and the secondary cooling spray nozzle 11B cools the metal powder 9 formed through division by the primary cooling water 7.

In accordance to aspects of the present invention, the impact pressures on the metal powder 9 of the secondary cooling water 10A and the secondary cooling water 10B sprayed from the secondary cooling spray nozzle 11A and the secondary cooling spray nozzle 11B, respectively are adjusted to 10 MPa or more. The upper limit is not particularly limited but is typically 50 Mpa or less.

Figure 4:
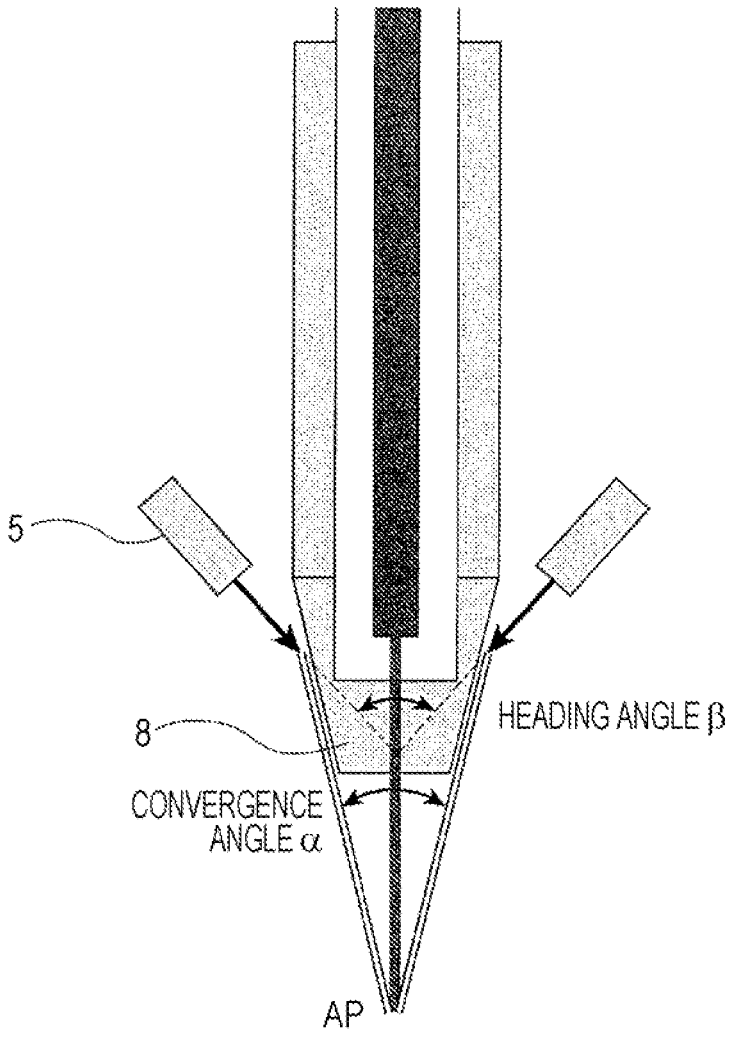
FIG. 4 schematically illustrates the AP.

The installation positions of the secondary cooling spray nozzle 11A and the secondary cooling spray nozzle 11B must be the positions at which secondary cooling water can be sprayed on the metal powder 9 that has been formed at the AP (atomization point), which is the impact point between the primary cooling water and the molten metal stream, and then fallen from the AP for 0.0004 seconds or more. The upper limit of the falling time (sphere-forming time) is not particularly limited but is preferably 0.0100 seconds or less. Moreover, the installation positions of the secondary cooling spray nozzle 11A and the secondary cooling spray nozzle 11B need to be the positions at which secondary cooling water can be sprayed on the metal powder when the average temperature of the metal powder is between the melting point of the metal powder or higher and (the melting point+100° C.) or lower. The temperature of the metal powder is determined by the method described hereinafter. The average temperature is preferably the melting point or higher and (the melting point+50° C.) or lower. When the guide 8 is used as in the present embodiment, the AP (atomization point) is the intersection between tangents that extend from the angle modification section surfaces of the guide at a convergence angle, the intersection between tangents to the slanting surfaces facing across the molten metal stream 6, and the impact point on the molten metal stream 6. The AP is schematically illustrated in FIG. 4.

The secondary cooling spray nozzle 11A and the secondary cooling spray nozzle 11B are provided at almost facing positions with the falling direction of the molten metal stream as the central axis. Herein, "almost facing" means facing within the range of 180°±10° with the molten metal stream as the center in the planar view. The number of the secondary cooling spray nozzles 11 is not particularly limited, but a plurality of the secondary cooling spray nozzles 11 are preferably provided at almost facing positions as described above in view of uniform cooling.

In the production method for water-atomized metal powder according to aspects of the present invention, water-atomized metal powder is produced while checking the temperatures of the molten steel 2, the molten metal stream 6, and the metal powder 9. Next, the concrete method of checking the temperatures will be described.

Figure 3:
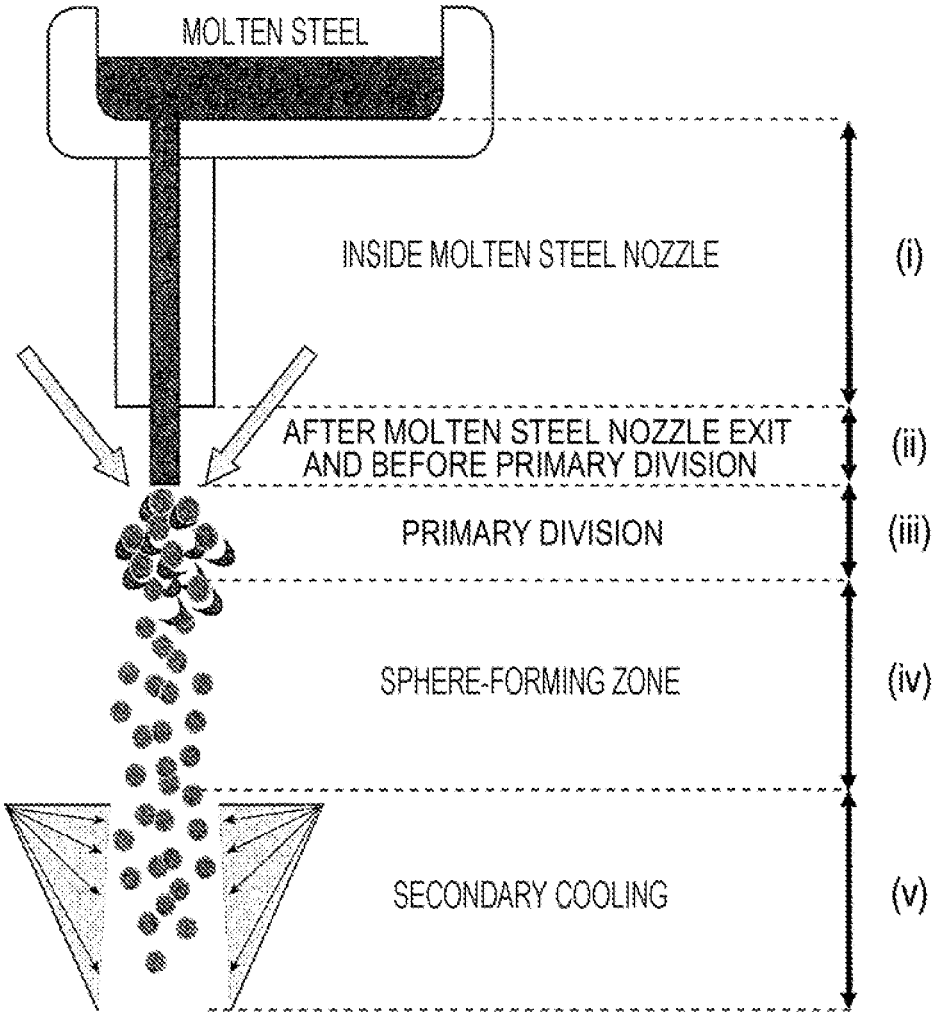
FIG. 3 shows segmented regions in a numerical simulation of the average temperatures of molten metal stream and metal powder.

In the production of water-atomized metal powder according to aspects of the present invention, the average temperature of the molten metal stream 6 during division by the primary cooling water 7 and the average temperature of the metal powder 9 during cooling by the secondary cooling water 10 are estimated and determined by a numerical simulation. FIG. 3 shows segmented regions in the numerical simulation, and Table 1 shows the calculation conditions and boundary conditions. Moreover, the energy exchange at a boundary was calculated by formula (1) below. Here, the first term is heat transfer and the second term is radiation in the right-hand side of formula (1).

TABLE 1

| | Forward difference calculation (calculation time interval of $10^{-5}$ s or less) | | | | Boundary conditions | | |
|---|---|---|---|---|---|---|---|
| | Position | Calculation mode | Initial temperature ($\theta_0$) | Moving rate | Heat input/output conditions | Boundary temperature $\theta_\infty$ | Concerning rise/lowering in heat transfer coefficient |
| (i) | Inside molten steel nozzle | Cylindrical coordinate system | Melting temperature | Molten steel moving rate/calculated from each distance | Contact heat transfer alone without thermal radiation ($\varepsilon = 0$) | Inner surface temperature of molten metal nozzle (heat transfer calculation also for cross-section of molten metal nozzle) | Cases of large contact heat transfer coefficient<br>High contact pressure, smooth surface, low hardness<br>Cases of small contact heat transfer coefficient<br>Low contact pressure, rough surface, high hardness |
| (ii) | After molten steel nozzle exit and before primary division | | Temperature at the end of preceding state | | Spontaneous cooling state (heat release to air) with thermal radiation | Water temperature (or space temperature) | Almost constant emissivity |
| (iii) | Primary division (primary cooling) | Spherical coordinate system | | Falling rate changed depending on spray pressure after atomization/calculated from each distance | Forced heat transfer (film boiling conditions) with thermal radiation | | Cases of large heat transfer coefficient<br>Large amount of cooling water, low cooling water temperature, high spray pressure (or impact pressure)<br>Cases of small heat transfer coefficient<br>Small amount of cooling water, high cooling water temperature, low spray pressure (or impact pressure) |
| (iv) | Sphere-forming zone | | | | Forced heat transfer (mild cooling) with thermal radiation | | Cases of large heat transfer coefficient<br>Large amount of falling water, low cooling water temperature, small amount of molten steel (per unit time)<br>Cases of small heat transfer coefficient<br>Small amount of falling water, high cooling water temperature, large amount of molten steel |
| (v) | Secondary cooling | | | | Forced convective heat transfer (corresponding to nucleate boiling) with thermal radiation | | Cases of large heat transfer coefficient<br>Large amount of cooling water, low cooling water temperature, high spray pressure (or impact pressure)<br>Cases of small heat transfer coefficient<br>Small amount of cooling water, high cooling water temperature, low spray pressure (or impact pressure) |

$$Q/A = h(\theta_0 - \theta_\infty) + \varepsilon\sigma(\theta_0^4 - \theta_\infty^4) \quad (1)$$

Q: amount of heat (W)
A: cross-sectional area ($m^2$)
h: contact heat transfer coefficient ($W/m^2 \cdot K$)
$\theta_0$: initial temperature (K)
$\theta_\infty$: boundary temperature (K)
$\varepsilon$: emissivity (−)
$\sigma$: Stefan-Boltzmann constant ($W/m^2 \cdot K^4$)

The region (i) in FIG. 3 is the inside of the molten steel nozzle, and the calculations are performed in a cylindrical coordinate system. In inside of the molten steel nozzle, the calculation time varies corresponding to the length of the molten steel nozzle and the moving rate of molten steel. The heat transfer to the molten steel nozzle is calculated by using the contact heat transfer coefficient. The contact heat transfer coefficient was set to about 2,000 to 10,000 $W/m^2 \cdot K$ [a concrete contact heat transfer coefficient is experimentally determined (the experimental method is in accordance with the method described in Transactions of the JSME A, 76 (763): 344-350, (2010-03-25), Evaluation of Thermal Contact Resistance at the Interface of Dissimilar Materials, Toshimichi Fukuoka, Masataka Nomura, Akihiro Yamada)], and emissivity was set to 0 without calculation of radiation. Further, the molten steel temperature was measured as the temperature during melting of the raw material using a radiation thermometer or a thermocouple.

The region (ii) in FIG. 3 is after the molten steel nozzle exit and before the starting point (corresponding to the AP in FIG. 2) of primary division by primary cooling water, and the calculations are performed in a cylindrical coordinate system. The heat of the molten metal stream was released to the space through spontaneous cooling. Accordingly, the heat transfer coefficient was about 18 to 50 $W/m^2 \cdot K$, and radiation was also calculated by setting the emissivity (=about 0.8 to 0.95). The average temperature of molten steel at the end of these calculations was set as the start temperature of primary division.

The region (iii) in FIG. 3 is from the starting point of primary division to the end point of primary division (the point at which effective primary division is possible) or during primary division (within the region where the molten metal stream is divided into metal powder). From this region, the calculations were performed in a spherical coordinate system. Moreover, the region is preferably within the range of 25 to 35 mm in the falling direction of the molten metal stream from the AP. The diameter of the spherical coordinate was calculated using an average particle size (target average particle size). The heat of molten steel is transferred to cooling water through forced convection, and film boiling conditions were attached thereto. The heat transfer coefficient was about 200 to 1,000 $W/m^2 \cdot K$ [determined based on the boiling state (film boiling) and the surrounding amount of water and flow state of water], and radiation was also calculated.

The region (iv) in FIG. 3 is a region from the end point of primary division to the starting point of secondary cooling and is regarded as a sphere-forming zone. Since water is present around molten steel, a heat transfer coefficient (about 100 to 200 $W/m^2 \cdot K$) was larger than the region (ii), and radiation was also calculated. The average temperature of metal powder at this point was regarded as the start temperature of secondary cooling.

The region (v) in FIG. 3 is a region of secondary cooling, and the temperature of metal powder is calculated from formula (1) and the conditions shown in Table 1.

Next, the advantageous effects of the production method for water-atomized metal powder according to aspects of the present invention will be described.

Conventional methods had difficulty in increasing an amorphous proportion and an apparent density for metal powder having a high Fe concentration by a low-cost high-productivity water atomization process. In contrast, aspects of the present invention can increase an amorphous proportion and an apparent density even for metal powder having a high Fe concentration by spraying, in a region in which an average temperature of the molten metal stream 6 is 100° C. or more higher than a melting point, primary cooling water 7 from a plurality of directions (two directions in the present embodiment) at a convergence angle $\alpha$ of 10° to 25°, where the convergence angle $\alpha$ is an angle between an impact direction on the molten metal stream 6 of the primary cooling water 7A from the primary cooling spray nozzle 5A and an impact direction on the molten metal stream 6 of the primary cooling water 7B from the primary cooling spray nozzle 5B; and spraying, in a region in which 0.0004 seconds or more have passed after an impact of the primary cooling water 7 and an average temperature of the metal powder 9 is a melting point or higher and (the melting point+100° C.) or lower, secondary cooling water on the metal powder 9 under conditions of an impact pressure of 10 MPa or more.

A high content of iron-group elements (Fe+Co+Ni) results in a high melting point. For this reason, the start temperature of cooling is high, and film boiling tends to occur from the start of cooling. As a result, it is difficult to increase an amorphous proportion to 95% or more by conventional methods. Concretely, when the total content of iron-group components (Fe, Ni, Co) in atomic percent is 76 at % or more and less than 82.9 at % and Cu content in atomic percent is 0.1 at % or more and 2 at % or less, an amorphous proportion is difficult to increase. However, according to aspects of the present invention, it is possible to increase an amorphous proportion and thus attain a higher magnetic flux density even if metal powder has such a composition. Consequently, the production method according to aspects of the present invention contributes to further high output and downsizing of motors.

Further, it was conventionally extremely difficult to increase an amorphous proportion to 95% or more when the average particle size of metal powder to be produced is attempted to be controlled to 5 μm or more. However, according to aspects of the present invention, it is possible to attain an amorphous proportion of 95% or more even when an average particle size is 5 μm or more. Here, the upper limit of the average particle size estimated to attain an amorphous proportion of 95% or more in accordance with aspects of the present invention is 75 μm. The particle size is measured through classification by sieving and calculated as an average particle size (D50) by a cumulative method. Moreover, laser diffraction/scattering-type particle size distribution measurement is also employed in some cases.

Examples

Examples and Comparative Examples were carried out using equipment similar to the production equipment illustrated in FIGS. 1 and 2 except for changing the numbers of primary cooling spray nozzles and secondary cooling spray nozzles.

For division of a molten metal stream by primary cooling water, 12 primary cooling spray nozzles were disposed at the bottom of a primary cooling nozzle header on a circumference of ϕ60 mm at a heading angle of 50° and sprayed primary cooling water at a spray pressure of 20 MPa and the total amount of water sprayed of 240 kg/min (20 kg/min per nozzle). The "heading angle" herein means an angle between extended lines of any two nozzles (see heading angle $\beta$ in FIG. 4). Moreover, sprayed water was allowed to impact on a guide, and the spray angle of the guide was selected from 17°, 23°, and 29°.

The sphere-forming time, which is the interval from division (the AP in FIG. 2) of the molten metal stream by primary cooling water to secondary cooling, was selected among 0.0001, 0.0015, and 0.002 seconds and results were compared.

Secondary cooling was carried out by 12 secondary cooling spray nozzles disposed on a circumference of ϕ100 mm in the horizontal direction to the chamber 19 at 40 kg/min per nozzle, the total amount sprayed of 480 kg/min, and a spray pressure of 90 MPa or 20 MPa. Here, a nozzle for 90 MPa sprayed downward at a spray angle of 30° and a maximum impact pressure of 22 MPa as measured with a pressure sensor. Meanwhile, a nozzle for 20 MPa sprayed downward at a spray angle of 50° and a maximum spray pressure of 5.0 MPa.

To carry out the production methods of the Examples and Comparative Examples, soft magnetic materials having the following composition were prepared. Here, "%" indicates "at %."

(i) Fe 76%-Si 9%-B 10%-P 5%

(ii) Fe 78%-Si 9%-B 9%-P 4%

(iii) Fe 80%-Si 8%-B 8%-P4%

(iv) Fe 82.8%-B 11%-P 5%-Cu 1.2%

Although each material was prepared to satisfy the intended composition, the actual composition had an error of about ±0.3 at % or contained other impurities in some cases when melting and atomization ended. Moreover, some changes in the composition occasionally arose due to oxidation or the like during melting, during atomization, and/or after atomization.

Next, the average temperature of molten steel during primary division in atomization and the average temperature of the divided molten steel during secondary cooling were estimated by the above-mentioned methods.

Each Example and Comparative Example is shown in Table 2. In the present examples, the conditions for producing soft magnetic metal powder were adjusted as shown in Table 2. Moreover, the average particle size, the amorphous proportion, and the apparent density were measured. The average particle size was measured by the foregoing method. The apparent density was measured in accordance with JIS Z 2504: 2012. The amorphous proportion was obtained, after removing extraneous materials from the resulting metal powder, by measuring an amorphous halo peak and crystalline diffraction peaks by the X-ray diffraction method, and calculating by the WPPD method. Here, the "WPPD method" is an abbreviation for whole-powder-pattern decomposition method. The WPPD method is described in detail in Hideo Toraya, Journal of the Crystallographic Society of Japan, vol. 30 (1988), No. 4. pp. 253-258.

TABLE 2

| | Composition (at %) | Fe-group components [Fe, Ni, Co] (at %) | Melting point (° C.) | Molten steel temperature (° C.) | Amount of falling molten steel (kg/min) | Cooling water temperature (° C.) | Conditions during primary division: Convergence angle (°) | Average temperature of molten steel stream during primary division (cooling) (° C.) | Type and number of nozzles | Cooling water spray pressure (MPa) | Amount of cooling water sprayed (kg/min) |
|---|---|---|---|---|---|---|---|---|---|---|---|
| Ex. 1 | (i)$Fe_{76}Si_9B_{10}P_5$ | 76.0 | 1140 | 1550 | 8.2 | 9 | 23 | 1310 | solid | 20 | 240 |
| | (ii)$Fe_{78}Si_9B_9P_4$ | 78.0 | 1165 | 1560 | | | | 1312 | nozzle × | | |
| | (iii)$Fe_{80}Si_8B_8P_4$ | 80.0 | 1173 | 1580 | | | | 1322 | 12 | | |
| | (iv)$Fe_{82.8}B_{11}P_5Cu_{1.2}$ | 82.8 | 1194 | 1600 | | | | 1333 | | | |
| Ex. 2 | (i)$Fe_{76}Si_9B_{10}P_5$ | 76.0 | 1140 | 1550 | 8.2 | 9 | 17 | 1308 | solid | 20 | 240 |
| | (ii)Fe78Si9$B_9P_4$ | 78.0 | 1165 | 1560 | | | | 1309 | nozzle × | | |
| | (iii)$Fe_{80}Si_8B_8P_4$ | 80.0 | 1173 | 1580 | | | | 1319 | 12 | | |
| | (iv)$Fe_{82.8}B_{11}P_5Cu_{1.2}$ | 82.8 | 1194 | 1600 | | | | 1330 | | | |
| Ex. 3 | (i)$Fe_{76}Si_9B_{10}P_5$ | 76.0 | 1140 | 1510 | 8.2 | 8 | 23 | 1259 | solid | 20 | 240 |
| | (ii)$Fe_{78}Si_9B_9P_4$ | 78.0 | 1165 | 1520 | | | | 1269 | nozzle × | | |
| | (iii)$Fe_{80}Si_8B_8P_4$ | 80.0 | 1173 | 1540 | | | | 1279 | 12 | | |
| | (iv)$Fe_{82.8}B_{11}P_5Cu_{1.2}$ | 82.8 | 1194 | 1560 | | | | 1306 | | | |
| Comp. Ex. 1 | (i)$Fe_{76}Si_9B_{10}P_5$ | 76.0 | 1140 | 1550 | 8.2 | 7 | 29 | 1310 | solid | 20 | 240 |
| | (ii)$Fe_{78}Si_9B_9P_4$ | 78.0 | 1165 | 1560 | | | | 1312 | nozzle × | | |
| | (iii)$Fe_{80}Si_8B_8P_4$ | 80.0 | 1173 | 1580 | | | | 1322 | 12 | | |
| | (iv)$Fe_{82.8}B_{11}P_5Cu_{1.2}$ | 82.8 | 1194 | 1600 | | | | 1333 | | | |
| Comp. Ex. 2 | (i)$Fe_{76}Si_9B_{10}P_5$ | 76.0 | 1140 | 1500 | 8.2 | 7 | 17 | 1250 | solid | 20 | 240 |
| | (ii)$Fe_{78}Si_9B_9P_4$ | 78.0 | 1165 | 1510 | | | | 1276 | nozzle × | | |
| | (iii)$Fe_{80}Si_8B_8P_4$ | 80.0 | 1173 | 1530 | | | | 1285 | 12 | | |
| | (iv)$Fe_{82.8}B_{11}P_5Cu_{1.2}$ | 82.8 | 1194 | 1550 | | | | 1306 | | | |
| Comp. Ex. 3 | (i)$Fe_{76}Si_9B_{10}P_5$ | 76.0 | 1140 | 1500 | 8.2 | 9 | 17 | 1308 | solid | 20 | 240 |
| | (ii)$Fe_{78}Si_9B_9P_4$ | 78.0 | 1165 | 1510 | | | | 1309 | nozzle × | | |
| | (iii)$Fe_{80}Si_8B_8P_4$ | 80.0 | 1173 | 1530 | | | | 1319 | 12 | | |
| | (iv)$Fe_{82.8}B_{11}P_5Cu_{1.2}$ | 82.8 | 1194 | 1550 | | | | 1330 | | | |

| | Composition (at %) | Sphere-forming time (s) | Conditions during secondary cooling: Average temperature of metal powder during secondary cooling (° C.) | Nozzle spray angle (°) | Type and number of nozzles | Spray pressure (MPa) | Amount of cooling water sprayed (kg/min) | Impact pressure (MPa) | Water/molten steel ratio (—) | Evaluation of powder: Average particle size [D50] (μm) | Apparent density (g/cm$^3$) | Amorphous proportion by X-ray diffraction [WPPD method] (%) | Result |
|---|---|---|---|---|---|---|---|---|---|---|---|---|---|
| Ex. 1 | (i)$Fe_{76}Si_9B_{10}P_5$ | 0.002 | 1210 | 30 | flat | 90 | 480 | 22 | 58.5 | 48 | 4.03 | 97 | ⊙ |
| | (ii)$Fe_{78}Si_9B_9P_4$ | | 1234 | | spray × | | | | | 47 | 4.01 | 97 | ○ |
| | (iii)$Fe_{80}Si_8B_8P_4$ | | 1243 | | 12 | | | | | 44 | 3.88 | 97 | ○ |
| | (iv)$Fe_{82.8}B_{11}P_5Cu_{1.2}$ | | 1256 | | | | | | | 44 | 3.43 | 95 | ○ |
| Ex. 2 | (i)$Fe_{76}Si_9B_{10}P_5$ | 0.0015 | 1212 | 30 | flat | 90 | 480 | 22 | 58.5 | 51 | 4.13 | 97 | ⊙ |
| | (ii)Fe78Si9$B_9P_4$ | | 1232 | | spray × | | | | | 48 | 4.12 | 96 | ⊙ |

TABLE 2-continued

| | | | | | | | | | | | | | |
|---|---|---|---|---|---|---|---|---|---|---|---|---|---|
| | (iii)$Fe_{80}Si_8B_8P_4$ | | 1239 | | 12 | | | | | 46 | 3.99 | 95 | ○ |
| | (iv)$Fe_{82.8}B_{11}P_5Cu_{1.2}$ | | 1251 | | | | | | | 47 | 3.96 | 95 | ○ |
| Ex. 3 | (i)$Fe_{76}Si_9B_{10}P_5$ | 0.0015 | 1170 | 30 | flat | 90 | 480 | 22 | 58.5 | 46 | 4.11 | 100 | ⊙ |
| | (ii)$Fe_{78}Si_9B_9P_4$ | | 1195 | | spray × | | | | | 47 | 3.99 | 100 | ⊙ |
| | (iii)$Fe_{80}Si_8B_8P_4$ | | 1204 | | 12 | | | | | 44 | 3.96 | 100 | ⊙ |
| | (iv)$Fe_{82.8}B_{11}P_5Cu_{1.2}$ | | 1220 | | | | | | | 44 | 3.95 | 99 | ⊙ |
| Comp. | (i)$Fe_{76}Si_9B_{10}P_5$ | 0.002 | 1210 | 30 | flat | 90 | 480 | 22 | 58.5 | 38 | 1.03 | 94 | X |
| Ex. 1 | (ii)$Fe_{78}Si_9B_9P_4$ | | 1234 | | spray × | | | | | 35 | 0.98 | 93 | X |
| | (iii)$Fe_{80}Si_8B_8P_4$ | | 1243 | | 12 | | | | | 38 | 1.13 | 94 | X |
| | (iv)$Fe_{82.8}B_{11}P_5Cu_{1.2}$ | | 1256 | | | | | | | 37 | 1.26 | 92 | X |
| Comp. | (i)$Fe_{76}Si_9B_{10}P_5$ | 0.0001 | 1225 | 30 | flat | 90 | 480 | 22 | 58.5 | 38 | 1.45 | 93 | X |
| Ex. 2 | (ii)$Fe_{78}Si_9B_9P_4$ | | 1261 | | spray × | | | | | 35 | 1.59 | 91 | X |
| | (iii)$Fe_{80}Si_8B_8P_4$ | | 1259 | | 12 | | | | | 38 | 1.63 | 88 | X |
| | (iv)$Fe_{82.8}B_{11}P_5Cu_{1.2}$ | | 1280 | | | | | | | 37 | 1.52 | 86 | X |
| Comp. | (i)$Fe_{76}Si_9B_{10}P_5$ | 0.0015 | 1212 | 50 | flat | 20 | 480 | 5 | 58.5 | 38 | 3.84 | 52 | X |
| Ex. 3 | (ii)$Fe_{78}Si_9B_9P_4$ | | 1232 | | spray × | | | | | 35 | 3.82 | 50 | X |
| | (iii)$Fe_{80}Si_8B_8P_4$ | | 1239 | | 12 | | | | | 38 | 3.82 | 43 | X |
| | (iv)$Fe_{82.8}B_{11}P_5Cu_{1.2}$ | | 1251 | | | | | | | 37 | 3.72 | 32 | X |

Examples 1 to 3 had an amorphous proportion of 95% or more at an apparent density of 3.0 g/cm$^3$ or more and an iron concentration of 76.0 at % to 82.9 at % since in a region in which the average temperature of a molten metal stream is 100° C. or more higher than the melting point, primary cooling water was sprayed from a plurality of directions at a convergence angle of 10° to 25°, where the convergence angle is an angle between an impact direction on the molten metal stream of the primary cooling water from one direction among a plurality of the directions and an impact direction on the molten metal stream of the primary cooling water from any other direction; and in a region in which 0.0004 seconds or more have passed after an impact of the primary cooling water and the average temperature of metal powder is the melting point or higher and (the melting point+100° C.) or lower, secondary cooling water was sprayed on the metal powder under conditions of an impact pressure of 10 MPa or more. In particular, when cooling by the secondary cooling water was performed at the melting point of metal powder or higher and (the melting point+50° C. or lower), an amorphous proportion was extremely high (98% or more).

Comparative Example 1 whose convergence angle of 29° is outside the specified range had an apparent density of less than 3.0 g/cm$^3$ and thus failed to obtain satisfactory results.

Comparative Example 2 whose sphere-forming time of 0.0001 seconds is outside the specified range had an apparent density of less than 3.0 g/cm$^3$ and failed to attain an amorphous proportion of 95%.

Comparative Example 3 whose impact pressure during secondary cooling of 5 MPa is outside the specified range had an amorphous proportion of less than 95%.

Further, when the metal powder of the Examples was subjected to appropriate heat treatment after compacting, nanosized crystals were deposited.

The size of nanocrystals was obtained using the Scherrer equation after measurement by XRD (X-ray diffractometer). In the Scherrer equation, K is a shape factor (typically 0.9), $\beta$ is a full width at half maximum (in radians), $\theta$ is $2\theta=52.505°$ (Fe (110)plane), and $\tau$ is a crystal size.

$\tau=K\lambda/\beta \cos\theta$ [Scherrer equation, JIS H 7805: 2005 10.1□b) equation 2)]

REFERENCE SIGNS LIST

1 Tundish
2 Molten steel
3 Molten steel nozzle
4 Primary cooling nozzle header
5 Primary cooling spray nozzles
6 Molten metal stream
7 Primary cooling water
8 Guide
9 Metal powder
10 Secondary cooling water
11 Secondary cooling spray nozzles
14 Atomizing apparatus
15 Cooling water tank
16 Temperature controller for cooling water
17 High-pressure pump for atomizing/cooling water
18 Pipe for atomizing/cooling water
19 Chamber

The invention claimed is:

1. A production method for water-atomized metal powder, comprising:

spraying primary cooling water that is to impact on a vertically falling molten metal stream to divide the molten metal stream into metal powder and to cool the metal powder, thereby producing water-atomized metal powder having a total content of iron-group components (Fe, Ni, Co) in atomic percent of 76.0 at % or more and less than 82.9 at % and an amorphous proportion of 95% or more, wherein:

in a region in which an average temperature of the molten metal stream is 100° C. or more higher than a melting point, the primary cooling water is sprayed from a plurality of directions to cause the primary cooling water to impact on a guide having a slanting surface that slants toward the molten metal stream and to move the primary cooling water along the slanting surface, thereby adjusting a convergence angle to 10° to 25°, the convergence angle being an angle between an impact direction on the molten metal stream of the primary cooling water from one direction among a plurality of the directions and an impact direction on the molten metal stream of the primary cooling water from any other direction; and in a region in which 0.0004 seconds or more have passed after an impact of the primary cooling water and an average temperature of the metal powder is a melting point or higher and (the melting point+100° C.) or lower, secondary cooling water is sprayed on the metal powder under conditions of an impact pressure of 10 MPa or more.

2. The production method for water-atomized metal powder according to claim 1, wherein the water-atomized metal powder has Cu content in atomic percent of 0.1 at % or more and 2 at % or less.

3. The production method for water-atomized metal powder according to claim 1, wherein the water-atomized metal powder has an average particle size of 5 μm or more.

4. The production method for water-atomized metal powder according to claim 2, wherein the water-atomized metal powder has an average particle size of 5 μm or more.

* * * * *